United States Patent [19]

Ebihara

[11] Patent Number: 4,488,054

[45] Date of Patent: Dec. 11, 1984

[54] STARTER APPARATUS

[75] Inventor: Kohei Ebihara, Katsuta, Japan

[73] Assignee: Hitachi, Ltd., Tokyo, Japan

[21] Appl. No.: 484,274

[22] Filed: Apr. 12, 1983

[30] Foreign Application Priority Data

Apr. 13, 1982 [JP] Japan ..... 57-61319
Jun. 2, 1982 [JP] Japan ..... 57-80609[U]
Sep. 1, 1982 [JP] Japan ..... 57-150754

[51] Int. Cl.[3] ..... F02N 11/00; F02N 15/06

[52] U.S. Cl. ..... 290/38 A; 290/38 R; 290/38 B; 290/46; 290/48; 74/6; 74/7 A

[58] Field of Search ..... 290/38 A, 38 B, 38 E, 290/38 R, 46, 48; 310/112; 318/384, 430, 136; 74/6, 7 A, 7 B, 7 R

[56] References Cited

U.S. PATENT DOCUMENTS 1,700,694 1/1929 Brownlee ..... 74/6
2,960,879 11/1960 Lafitte ..... 74/6
3,177,368 4/1965 Seilly ..... 290/38 R
3,399,576 9/1968 Seilly et al. ..... 290/38 R X
4,304,140 12/1981 Ebihara ..... 74/7 A X

*Primary Examiner*—J. V. Truhe
*Assistant Examiner*—Paul Shik Luen Ip
*Attorney, Agent, or Firm*—Antonelli, Terry & Wands

[57] ABSTRACT

A starter apparatus comprises a D.C. motor, a solenoid actuator, a hollow sleeve having at one end thereof a pinion and a one way clutch. A torque of an armature of the D.C. motor is transmitted through the one way clutch to the hollow sleeve and further transmitted to a ring gear of an engine, which is engaged with a pinion of the hollow sleeve, thereby performing a start up of the engine. The engagement or disengagement between the pinion and the ring gear is carried out by means that the solenoid actuator reciprocates only the hollow sleeve through a shift lever.

4 Claims, 8 Drawing Figures

STARTER APPARATUS

BACKGROUND OF THE INVENTION

FIELD OF THE INVENTION

The present invention relates to a starter apparatus for a vehicle engine and, more particularly, to a starter apparatus of such type that a ring gear of a vehicle engine is rotated through a one way clutch by a D.C. motor of the starter.

DESCRIPTION OF THE PRIOR ART

Figure 1:
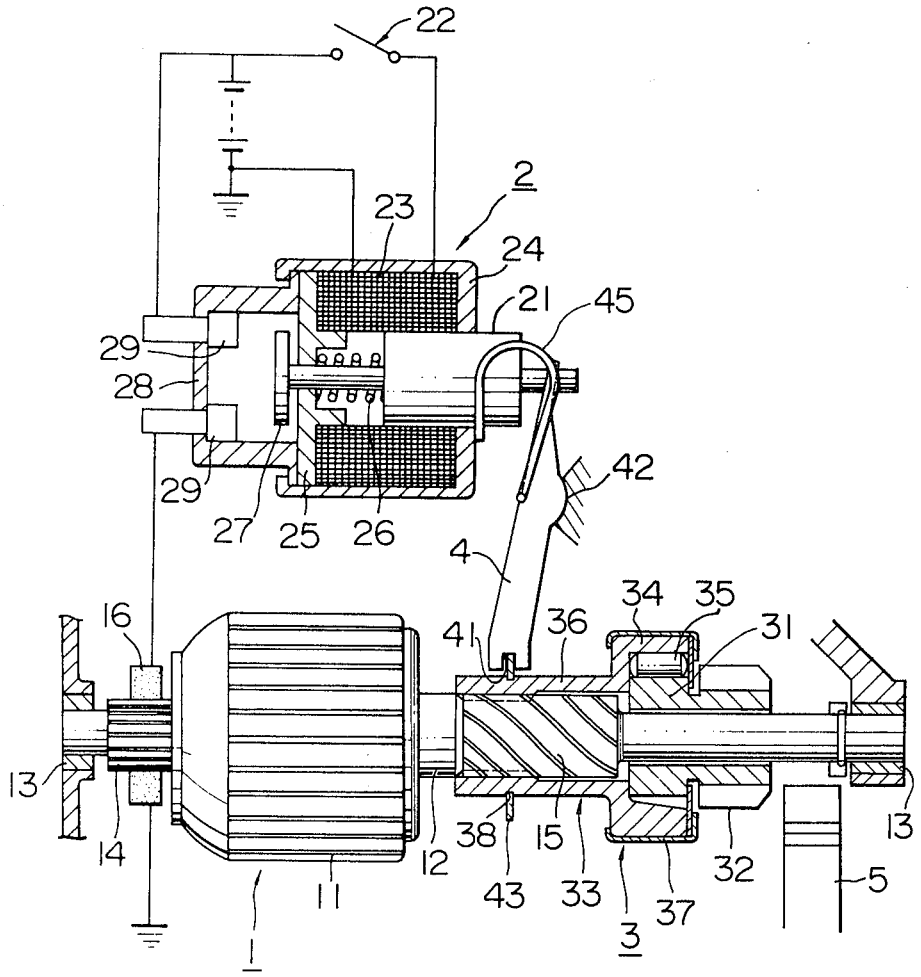
FIG. 1 is a fragmentary sectional view of a starter apparatus in accordance with the prior art.

As shown in FIG. 1, a prior art starter apparatus comprises a D.C. motor 1, a solenoid actuator 2 and a one way clutch 3. A shaft 12 projects from opposite end walls of an armature 11 adapted to be rotated within the D.C. motor 1 and both ends of the shaft 12 are born by metal bushes 13 and 13 respectively. A commutator 14 is mounted on the shaft 12 and adjacent to one end wall of the armature 11. A helical spline 15 is formed around an outer peripheral portion of the shaft 12 opposite to the commutator 14. The one way clutch 3 includes a hollow inner race 31 which is slidably mounted on the shaft 12 and provided at one end portion thereof with a pinion 32, and an associated outer race 33. A larger diameter portion 34 of the outer race 33 houses the hollow inner race 31 through rollers 35. On an inner peripheral surface of a smaller diameter portion 36 of the outer race 33 are provided projections which engage with the helical spline 15 of the shaft 12. The hollow inner race 31 and the outer race 33 are coupled to each other by an embracing cover 37. In an outer periphery of the smaller diameter portion 36 of the outer race 33 is provided an annular groove 38 in which an annulus plate or washer 43 is fixedly received. A shift lever 4 is fulcrumed at a middle portion 42 thereof, one end of which is provided with a recess 41 housing a peripheral portion of the annulus plate 43 and the other end of which is mounted to an end of a reciprocative plunger 21 of the solenoid actuator 2.

An operation of the starter apparatus having above-mentioned constitution will now be explained.

First of all, when a switch 22 of the starter apparatus is closed, a solenoid coil 23 is energized, so that a magnetic circuit including a casing 24, the plunger 21 and an end wall 25 is generated. By a magnetic force generated in the magnetic circuit, the plunger 21 is moved against a spring force of a compression spring 26 in the leftward direction in the drawing. The leftward movement of the plunger 21 allows the one end of the shift lever 4 to swing about the fulcrumed portion 42 and thus the annulus plate 43 to be moved together with the one way clutch 3 in the rightward direction in the drawing. As a result, the pinion 32 and a ring gear 5 of the engine are engaged with each other. A moving contact 27 is attached to the other end of the plunger 21. Also, on a bottom portion of a cover 28 which is fixed to the end wall 25 and covers the moving contact 27, there are provided two fixed contacts 29, and 29 spaced from each other. One of the fixed contacts 29 is electrically connected to a power source while the other 29 is electrically connected to the D.C. motor 1. When the plunger 21 is moved leftwardly as described above, the moving contact 27 is come into contact with both fixed contacts 29 and 29 whereby an electrical connection between the two fixed contacts is achieved. By this connection, the D.C. motor 1 is energized and the armature 11 is rotated. The rotation of the armature 11 is transmitted to the ring gear 5 through the one way clutch 3 and the pinion 32, so that the engine is started. The one way clutch 3 transmits the torque of the armature 11 to the pinion 32 through the rollers 35. However, when the engine is started and then the ring gear 5 is rotated at a high speed by the engine, the rollers 35 are loosely rotated. Therefore, no transmission of the rotational torque from the engine to the armature 11 is performed.

Subsequently, when the switch 22 is opened, the magnetic force generated in the magnetic circuit is eliminated. Then, the plunger 21 is moved rightwardly by the spring force of the compression spring 26 and is returned back to the original position. The rightward movement of the plunger 21 allows the shift lever 4 to swing about the fulcrumed portion 42. The one way clutch 3 is moved leftwardly together with the annulus plate 43 and the engagement between the pinion 32 and the ring gear 5 is released. Since the rightward movement of the plunger 21 stops the power supply to the D.C. motor 1, the D.C. motor 1 is ceased.

Figure 2:
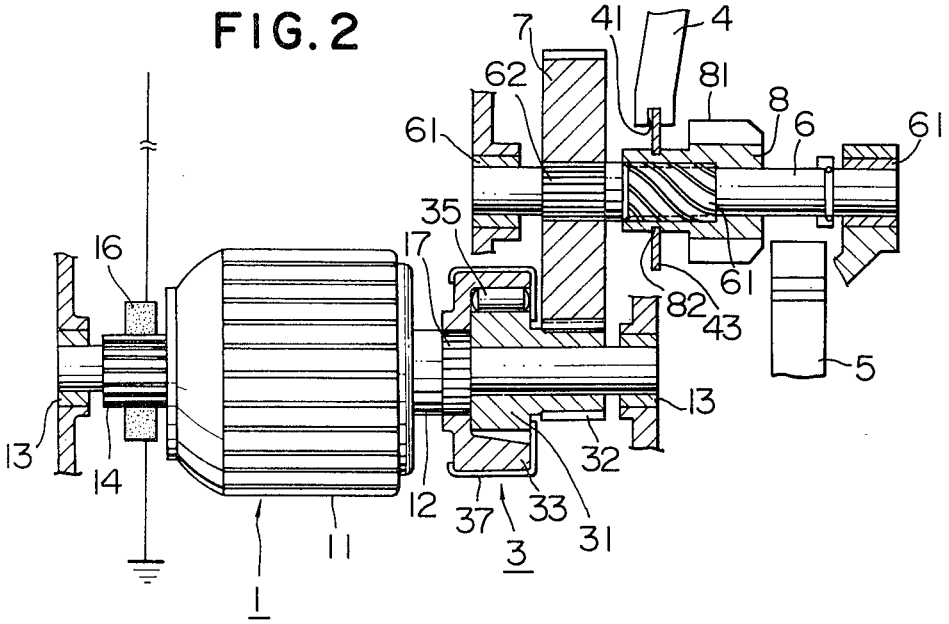
FIG. 2 is a fragmentary sectional view of another starter apparatus in accordance with the prior art, in which a solenoid actuator is omitted.

FIG. 2 shows another prior art starter apparatus. In this starter apparatus, the solenoid actuator 2 and the shift lever 4 used in the starter apparatus shown in FIG. 1 are actually used but omitted from the drawing. The same reference numerals are used to designate the same components and members as in the starter apparatus shown in FIG. 1. In the starter apparatus shown in FIG. 2, the one way clutch 3 is fixedly mounted to the shaft 12 through a straight spline 17 and an intermediate shaft 6 is additionally used. The intermediate shaft 6 is born at both ends thereof by metal bushes 61 and 61. An intermediate gear 7 is fixedly mounted on the intermediate shaft 6 through a straight spline 62. The intermediate gear 7 and the pinion 32 of the hollow inner race 31 of the one way clutch 3 are always engaged with each other. A hollow sleeve 8 is reciprocatively mounted on the intermediate shaft 6 through a helical spline 61 formed on the outer periphery of the intermediate shaft 6. The hollow sleeve 8 is provided at one end portion thereof with a pinion 81 and at the other end portion with an annular groove 82 in which an annulus plate 43 is received.

An operation of the starter apparatus having above-mentioned constitution will now be explained.

First of all, when a switch (not shown) of the starter apparatus is closed, the end of the shift lever 4 is swung and the hollow sleeve 8 is moved together with the annulus plate 43 in the rightward direction in the drawing. As a result, the pinion 81 and the ring gear 5 of the engine are engaged with each other. Subsequently, as described before, the armature 11 is rotated and a torque of the armature 11 is transmitted to the ring gear 5 through the one way clutch 3, the intermediate gear 7, the intermediate shaft 6 and the pinion 81.

The starter apparatus shown in FIG. 1 is so constructed that the one way clutch 3 as a whole is moved by the shift lever 4. This construction is simple. However, the mass of object to be moved, i.e., the whole one way clutch is unduly large, so that a larger solenoid actuator 2 having a great capacity and a high rigid shift lever 4 are required for the starter apparatus. This leads to the disadvantages that the apparatus per se becomes large and its weight and cost are unduly increased. To the contrary, in the starter apparatus shown in FIG. 2 only the hollow sleeve 8 is moved by the shift lever 4. In such a construction, since the object to be moved, i.e., only the hollow sleeve has a small mass, a compact solenoid actuator 2 may be used. However, the additional components such as intermediate gear 7, intermediate shaft 6 and the like must be used, which encounters disadvantages that the final construction becomes complex and that since the pinion 81 is rotated at a high speed by the ring gear 5 immediately after the engine starts, the relative rotational speed between the annulus plate 43 and the recess 41 of the shift lever 4 becomes higher, so that the abrasion therebetween is promoted.

SUMMARY OF THE INVENTION

Accordingly, an object of the present invention is to overcome the abovementioned disadvantages.

Another object of the present invention is to provide a starter apparatus which is compact, lightweight and relatively simple in construction.

These and other objects, features and advantages of the present invention will become clear from the following description of the preferred embodiments.

DETAILED DESCRIPTION OF THE PREFERRED EMBODIMENTS

Figure 3:
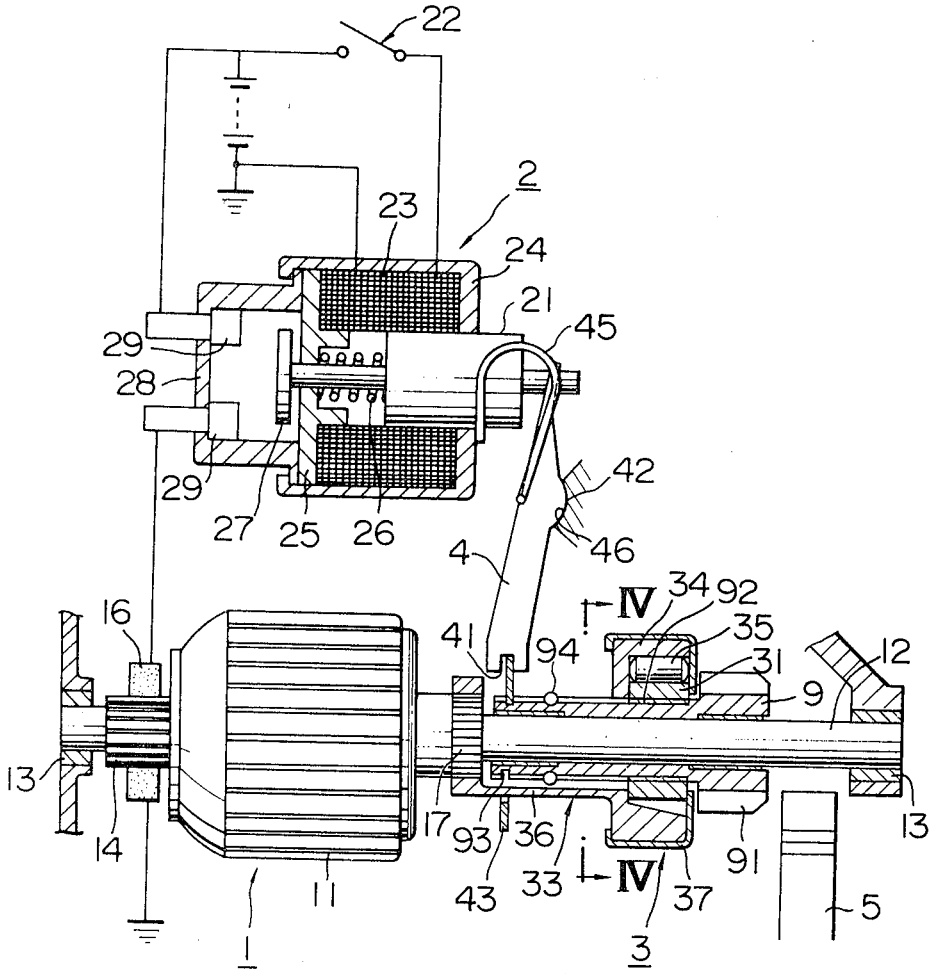
FIG. 3 is a fragmentary sectional view of a starter apparatus in accordance with one embodiment of the present invention.

FIG. 3 shows one embodiment of the present invention, in which the same reference numerals are used to designate the same members and components as in the above-described starter apparatus.

In FIG. 3, a hollow sleeve 9 is slidably mounted on a portion of the shaft 12 of the armature 11 opposing to the commutator 14. The hollow sleeve 9 is provided at one end thereof with a pinion 91. A portion of the outer periphery of the hollow sleeve 9 adjacent to the pinion 91 is slidably housed within the inner race 31 through a helical spline 92. The outer race 33 of the one way clutch 3 is a reducer comprising a larger diameter portion 34 and a smaller diameter portion 36. The larger diameter portion 34 houses the inner race 31 through rollers 35. The whole hollow sleeve 9 is housed within the one way clutch except for its pinion portion 91. A free end portion of the smaller diameter portion 36 of the outer race 33 of the one way clutch 3 is fixedly mounted to the shaft 12 through a straight spline 17 formed thereon. A peripheral wall of the smaller diameter portion 36 is cut away circumferencially along a semicircle thereof and also cut away along a predetermined axial length (see FIG. 4).

Figure 5:
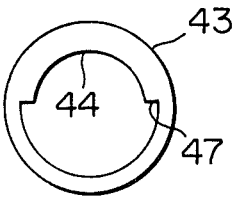
FIG. 5 is a frontal view of an annulus plate used in the starter apparatus shown in FIG. 3.

An annular groove 93 is provided in the free end portion of the hollow sleeve 9. An annulus plate 43 shown in FIG. 5 is slidably mounted on the outer periphery of the smaller diameter portion 36 of the outer race 33. An inner peripheral portion 44 projecting radial inwardly is received in the annular groove 93 of the hollow sleeve 9 through the cutaway opening portion of the outer race 33.

An operation of the starter apparatus having abovementioned constitution will be explained. As described before, when the switch 22 of the starter apparatus is closed, the plunger 21 is moved leftwardly by the magnetic force. The shift lever 4 is swung about the fulcrumed portion 42 thereof and only the hollow sleeve 9 is moved rightwardly through the annulus plate 43 and the pinion 91 and the ring gear 5 are engaged with each other. Subsequently, the two fixed contacts 29 and 29 are electrically connected to each other through the moving contact 27 and the armature 1 is rotated thereby. A torque of the armature 11 is transmitted through the shaft 12, the outer race 33, the inner race 31, the hollow sleeve 9 and the pinion 91 to the ring gear 5, and the engine is started. In this embodiment, a stop ring 94 is mounted on the outer periphery of the hollow sleeve 9 for preventing the further movement of the hollow sleeve 9 when the ring gear 5 and the pinion 91 are fully engages with each other. The stop ring 94 is positioned so as to be come into contact with the end face of the inner race 31 when the ring gear 5 and the pinion 91 are fully engaged with each other.

Furthermore, in this embodiment, an engaging spring 45 is interposed between the shift lever 4 and the solenoid actuator 2 for assisting the hollow sleeve 9 in engaging with the ring gear 5. Normally, the engagement spring 45 serves to bias the shift lever 4 against a bearing portion 46 for the fulcrumed portion 42. However, in the case that the movement of the hollow sleeve 9 is prevented by abutment of the end faces of the teeth thereof and the engagement between the pinion 9 and the ring gear 5 is insufficient, the shift lever 4 is separated away from the bearing portion 46 and is swung counterclockwise against the engaging spring 45 about the engagement portion between the recess 41 and the annulus plate 43. Then, when the two fixed contacts are electrically connected and the armature 11 is rotated, the pinion 9 is also rotated and the abutment of the end faces of the teeth is released, so that the ring gear 5 may be engaged with the pinion 9. At this time, the shift lever 4 is swung counterclockwise about the engagement portion between the plunger 21 and the shift lever 4 by the spring force of the spring 45 whereby the pinion 9 and the ring gear 5 is engage with each other.

As compared with the starter apparatus shown in FIG. 1, in the starter apparatus having abovementioned constitution the object to be moved is not the whole one way clutch 3 but only the hollow sleeve 9. Namely, the mass of the object to be moved is decreased according to the present invention. Accordingly, since a drive force of the solenoid actuator 2 may be reduced, the weight of the solenoid actuator 2 may effectively be reduced. Furthermore, a spring force of the spring 45 may be also reduced. The hollow sleeve 9 having a light weight is moved, so that when the hollow sleeve 9 is come into engagement with the ring gear 5 a collosion therebetween is small and a frictional abrasion may be reduced with an advantage of a quick response.

On the other hand, in comparison with the other prior art starter apparatus shown in FIG. 2, the present invention does not use the intermediate shaft 6. the intermediate gear 7 and the like, so that the number of the mechanical parts as well as the production cost and the assembly processes may be reduced.

Furthermore, after the engine is operated.by the starter apparatus, inversely since the hollow sleeve 8 is rotated at a high speed by the engine, the engagement surfaces of the annulus plate 43 and the recess 41 of the shift lever 4 receiving the annulus plate 43 which is rotated together with the hollow sleeve 8 are likely to be abraded by the high speed rotation. However, in the starter apparatus according to the present invention, the hollow sleeve 9 is rotated at a large number of revolutions $N_1$ by the engine whereas the annulus plate 43 is, as a shoulder 47 thereof is in abutment with the smaller diameter portion 36 of the outer race 33, rotated at the number of revolutions $N_2(N_2<N_1)$ by the rotation of the armature 11. Accordingly, the engagement portion between the inner peripheral portion 44 of the annulus plate 43 and the annular groove 93 formed in the hollow sleeve 9 is rotated at the relative number of revolutions which is equal to a difference between $N_1$ and $N_2$, and hence an amount of abrasion is reduced. Also, since the engagement portion between the outer peripheral portion of the annulus plate 43 and recess 41 formed in the shift lever 4 is rotated at the number of revolutions $N_2$ of the armature 11, an amount of abrasion is also reduced.

Figure 4:
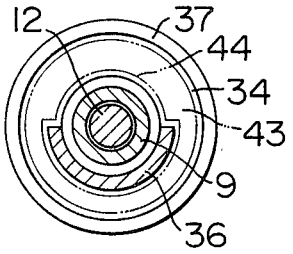
FIG. 4 is a cross-sectional view taken along the line IV—IV of FIG. 3.
Figure 6:
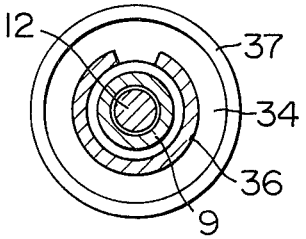
FIGS. 6 and 7 are cross-sectional views showing respective smaller diameter portions of outer races of one way clutches in accordance with other embodiments of the present invention.
Figure 7:
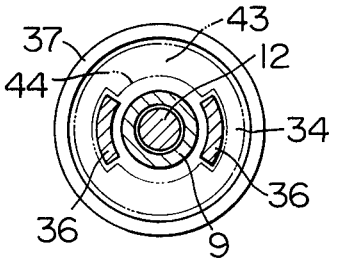

In the embodiment shown in FIG. 3, the cutaway portion or opening of the smaller diameter portion 36 of the outer race 33 extends substantially along a semicircle thereof as shown in FIG. 4. However, by modifying the configuration of the radially inwardly projecting inner edge portion 44 of the annulus plate 43, cutaway portions as shown in FIGS. 6 and 7 may be used. Namely, the smaller diameter portion 36 of the outer race 33 may be partially cut away in the circumferential direction (FIG. 6) or the smaller diameter portion 36 may be cut away at two portions in the circumferential direction (FIG. 7). It should be, however, understood that in any of the embodiments the above described advantage and resultant effect may be obtained.

Figure 8:
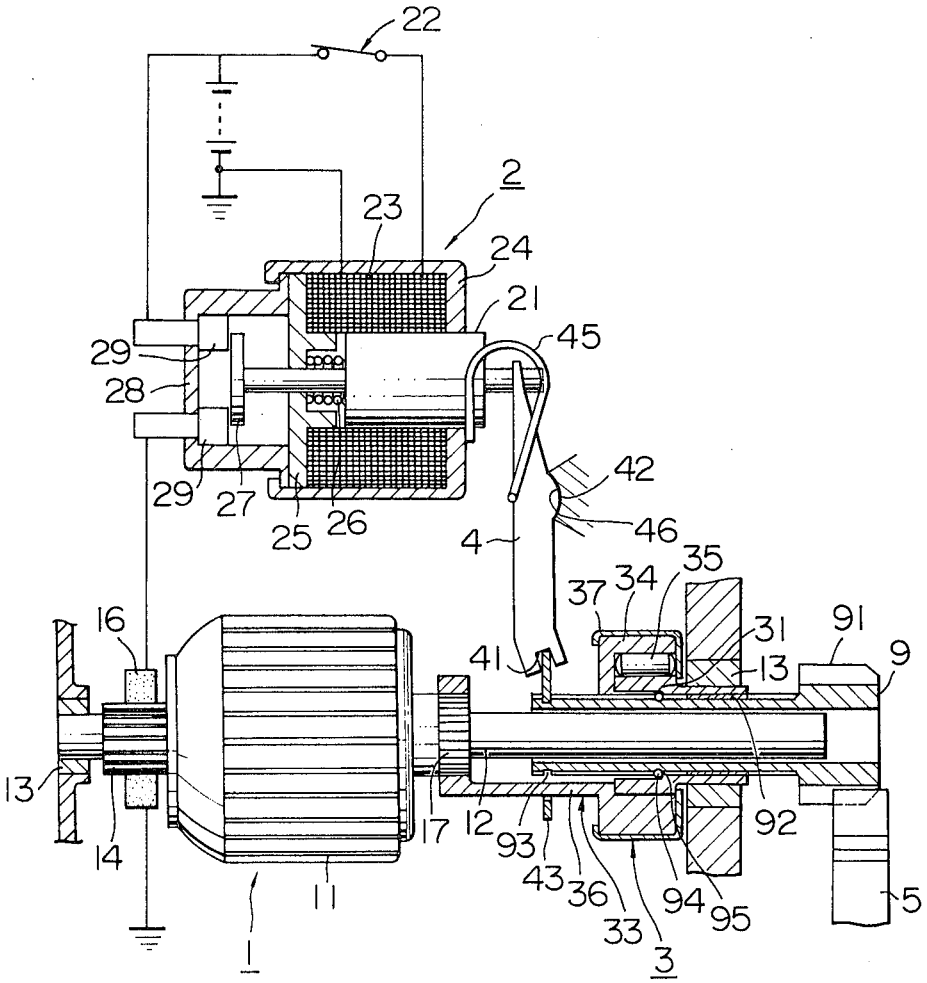
FIG. 8 is a fragmentary sectional view of another embodiment of the present invention.

FIG. 8 shows still another embodiment of the present invention. In this embodiment, upon rotation of the hollow sleeve 9, i.e., when the pinion 91 and the ring gear 5 are fully engaged with each other, the stop ring 94 is adapted to be received in the inner race 31. The inner race 31 has different two inner diameters, the larger inner diameter being selected to allow the stop ring 94 mounted on the hollow sleeve 9 to pass through the inner race and the smaller inner diameter being selected not to allow the stop ring 94 to pass through the inner race. Normally, when the ring gear 5 and the pinion 91 are fully engaged with each other, the stop ring 94 is mounted in an annular groove 95 formed at a portion of the hollow sleeve 9 where the stop ring 94 may be come into contact with the smaller inner diameter portion of the inner race 31. However, in the case that the hollow sleeve 9 is rotated at a high speed, for example, in the case that it is rotated by the engine through the ring gear 5, the stop ring 94 mounted in the hollow sleeve 9 is also rotated at a high speed. Therefore, there is a fear that the stop ring 94 might be jumped away from the annular groove 95 by a large centrifugal force. However, in the last-mentioned embodiment, upon rotation of the hollow sleeve 9, the stop ring 94 is housed by the inner wall of the inner race 31 and hence there is no fear that the stop ring 94 might be jumped away radial outwardly.

What is claimed is:

1. A starter apparatus for a vehicle engine comprising:

a D.C. motor including an armature, a solenoid actuator including a reciprocative plunger, a hollow sleeve which is provided at one end portion thereof with a pinion adapted to be engaged with a ring gear of said vehicle engine and which is slidably mounted upon a shaft projecting from one end of said armature, a one way clutch including an inner race which houses a middle portion of said hollow sleeve slidably through helical spline engagement, and an outer reducer race which houses said inner race through rollers at a larger inner diameter portion of said outer reducer race and which is fixed at free end thereof to said armature shaft, and a shift lever driven by said plunger so as to reciprocate said hollow sleeve to disengage or engage said pinion with said ring gear through an annulus plate, characterized in that:

a free end portion of a smaller inner diameter portion of said outer reducer race is fixed to said armature shaft;

said hollow sleeve is provided at the other end portion thereof with an annular groove;

a wall of said smaller inner diameter portion of said outer reducer race is provided at least one opening having a circumferential width and an axial length;

at least a portion of an inner circumferential edge of said annulus plate having a circumferential length smaller than the circumferential width of said opening extends radially inwardly into said annular groove through said opening;

the rest of said inner circumferential edge of said annulus plate encloses said wall of the smaller inner diameter portion of said outer reducer race; and said axial length of said opening in said outer reducer race is sufficient to permit said annulus plate to reciprocate said hollow sleeve to engage said pinion with said ring gear.

2. A starter apparatus as claimed in claim 1, wherein said opening in said outer race extends circumferentially substantially along the semicircle thereof.

3. A starter apparatus as claimed in claim 1 or 2, wherein a stop ring is fixed onto a periphery of said hollow sleeve, and wherein when said pinion is moved and fully engaged with said ring gear, said stop ring is abutted against said inner race so as to prevent the further axial movement of said hollow sleeve.

4. A starter apparatus as claimed in claim 3, wherein said inner race includes at least two different inner diameters, a larger one permits said stop ring to pass therein and a smaller one prevents the further axial movement of said stop ring whereby said stop ring is housed within said inner race.

* * * * *